United States Patent [19]

Mullen, III

[11] 4,332,387

[45] Jun. 1, 1982

[54] PUZZLE COMPRISING BLOCKS WITH RABBETED ENDS

[76] Inventor: John W. Mullen, III, 5365 Montrose, Dallas, Tex. 75209

[21] Appl. No.: 243,992

[22] Filed: Mar. 16, 1981

[51] Int. Cl.[3] ..... A63F 9/12

[52] U.S. Cl. ..... 273/156; 46/24; 273/160

[58] Field of Search ..... 273/156, 157 R, 160; 46/24; D21/304

[56] References Cited

U.S. PATENT DOCUMENTS

| | | | |
|---|---|---|---|
| 332,256 | 12/1885 | Keeler | 273/160 |
| 384,902 | 4/1908 | Critchett | 273/157 R X |
| 3,065,970 | 11/1962 | Besley | 273/160 |
| 3,375,009 | 3/1968 | Stubbmann et al. | 273/156 |
| 3,638,949 | 2/1972 | Thompson | 273/157 R |
| 3,919,786 | 11/1975 | Taska | 46/24 X |
| 3,981,506 | 9/1976 | Daniel et al. | 273/157 R |
| 4,210,333 | 7/1980 | Shanin | 273/157 R |
| 4,286,952 | 9/1981 | Roche | 273/156 X |

FOREIGN PATENT DOCUMENTS

| | | | |
|---|---|---|---|
| 193377 | 2/1938 | Switzerland | 46/24 |

OTHER PUBLICATIONS

Mag-Nif brochure, Puzzle No. 304 entitled Torus.

*Primary Examiner*—Anton O. Oechsle
*Attorney, Agent, or Firm*—Richards, Harris & Medlock

[57] ABSTRACT

A puzzle includes a plurality of elongated blocks (22–37) of square cross section. Each block has a first end (**22*a*–37*a*) rabbeted along one of the diagonals of the square cross section to form two turning treads separated by a riser and a second end (22*b*–37*b*) opposite the first end rabbeted to form two straight treads separated by a riser. A base container (38) having a bottom (40) and walls (42**) extending therefrom receives the blocks therein with either the first or second end of each block engaging the bottom of the base container. The opposite end of each block is positioned upwardly to form a desired configuration of the blocks extending from the base container.

14 Claims, 6 Drawing Figures

PUZZLE COMPRISING BLOCKS WITH RABBETED ENDS

TECHNICAL FIELD

The present invention relates to a puzzle and more particularly to a puzzle including a plurality of elongated blocks which may be arranged in a side-by-side relationship to produce a desired visual appearance.

BACKGROUND ART

Many puzzles involve the use of blocks or cubes or similar component parts which are assembled to form a desired finished configuration. Many of these puzzles provide for a plurality of ways in which the components may be assembled to produce a variety of assembled configurations. An example of such puzzles is found in U.S. Pat. No. 3,065,970 to S. S. Besley, wherein a three dimensional puzzle is provided consisting of a group of simply shaped interfitting pieces which may be variously arranged in relation to one another to form various aggregate structures.

Another type of puzzle is of the form disclosed in U.S. Pat. No. 884,902 to J. C. Critchett. This type of puzzle includes a plurality of irregularly shaped blocks which may be assembled to form a singly defined solid form.

Although these puzzles provide the challenge of determining a defined relationship between the various components to produce a final solid form, they are unlike the present invention which provides an almost limitless range of combinations of elements to produce final configurations which are unique as well as aesthetically appealing.

SUMMARY OF THE INVENTION

The present invention is to a puzzle including a plurality of elongated blocks, each having a square cross section. Each block has a first end rabbeted along a diagonal to form two turning treads with a riser therebetween and a second end opposite the first end, rabbeted to form two straight treads with a riser therebetween. In accordance with one embodiment of the invention, the blocks vary in length one from the other.

Each of the blocks may be positioned in a side-by-side relationship with either the first or second end engaged against a common surface, with the opposite end of the blocks exposed upwardly. By varying the arrangement of the blocks, an almost unlimited number of configurations may be attained.

More specifically, by placing certain of the blocks in a side-by-side relationship with the first ends downward against a common surface, the second ends of the blocks may be made to form a stairway. By placing one of the blocks at the end of this stairway with its second end downward on the common surface, two turning steps are formed at the end of the stairway provided by the blocks having their second end exposed upwardly. Continuing this arrangement, an almost limitless number of stairways may be formed using the blocks of the present invention.

In accordance with a more specific embodiment of the invention, the dimension of the riser between the two treads on each end of each block is equal for each of the blocks. Moreover, the difference in overall length from one block to the next shorter block is an equal increment which is equal to twice the dimension of the riser between the treads formed on each end of each block.

In a preferred embodiment of the invention, the blocks are received within a base container having a bottom and sidewalls extending upwardly therefrom to facilitate arrangement of the blocks with one end of each block engaged against the bottom of the base container. The bottom of the base container has an area substantially equal to the cross-sectional area of the blocks to be received within the base container, and the geometrical shape of the bottom of the base container may be any configuration which may be made by a combination of the elongated blocks to be placed in the container. In this way, the blocks are retained in position by the walls of the container when inserted within the base container.

BRIEF DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENTS

Figure 1:
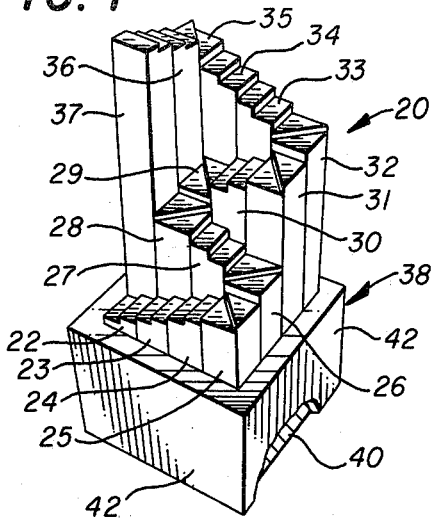
FIG. 1 is a perspective view of the puzzle of the present invention.

FIG. 1 is a perspective view of a puzzle 20 embodying the present invention. In the embodiment illustrated in FIG. 1, puzzle 20 includes sixteen elongated blocks 22 through 37. In this specific embodiment, blocks 22 through 37 are maintained in a standing, grouped position within a base container 38. Although blocks 22 through 37 and base container 38 may be constructed from wood or plastic, it will be understood that these components may be made from numerous other materials. The present invention is not limited to the type of material used to construct the components.

Referring to FIG. 1, base container 38 includes a square base 40 with sidewalls 42 extending upwardly therefrom. The walls of base container 38 are rectangular and extend perpendicularly from base 40. The cross-sectional configuration of the opening into the base container is substantially equal to the combined cross-sectional area of all of the sixteen blocks to be inserted therein. Moreover, the opening configuration is square in this particular embodiment.

Figure 2:
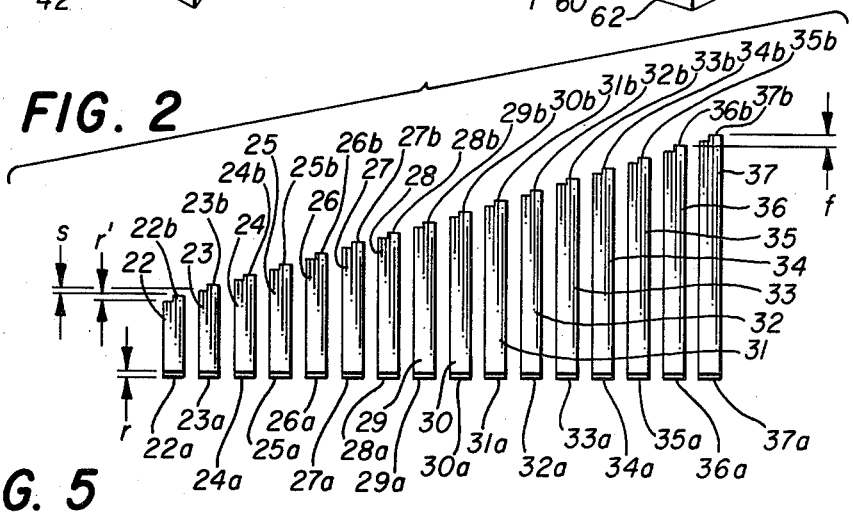
FIG. 2 is a side view of the blocks used in the puzzle of the present invention.

FIG. 2 illustrates the sixteen blocks 22 through 37 removed from base container 38 and arranged in order of increasing length from left to right, block 22 being the shortest and block 37 being the longest. In the embodiment illustrated in FIG. 1, each block differs in overall length from the next shortest block by a dimension equal to the dimension represented by f. For example, as is shown in FIG. 2, block 36 is shorter than block 37 by a dimension equal to f. Likewise, block 35 is shorter than block 36 by a dimension equal to f. In the preferred embodiment, this same relationship exists between each block and the next shorter block.

Figure 3:
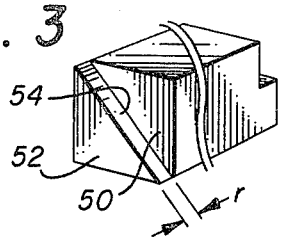
FIG. 3 is a perspective view showing a typical first end of the blocks used in the present invention.

As seen in FIG. 2, the lower end of blocks 22 through 37 is designated with the subscript a with the upper ends being designated with the subscript b. FIG. 3 illustrates the typical configuration of ends 22*a* through 37*a*. These ends are rabbeted along a diagonal of the cross section of the block to form lower and upper turning treads 50 and 52, respectively, with a vertical riser 54 therebetween. The distance between lower turning tread 50 and upper turning tread 52 is identified as r in both FIGS. 2 and 3.

Figure 4:
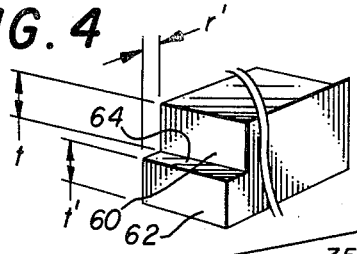
FIG. 4 is a perspective view showing a typical second end, opposite the first end, of the blocks used in the present invention.

FIG. 4 illustrates in perspective view the typical configuration of ends 22*b* through 37*b* of blocks 22 through 37. These ends are rabbeted to form two straight treads including a lower tread 60 having a depth t and an upper tread 62 having a depth t′ separated by vertical riser 64. The distance between lower tread 60 and upper tread 62 is identified in both FIG. 2 and FIG. 4 by the letter r′. Although the treads 60 and 62 are equal in depth and are approximately twice the dimension of the riser 64 in the drawings, this relationship is not critical to the invention and may be varied as desired.

Referring now to FIG. 2, it is also seen that the dimensions r and r′, that is, the dimension of the riser between the lower and upper turning treads 50 and 52 and between lower and upper straight treads 60 and 62, are equal. As is shown in FIG. 2, the letter s identifies the dimension, with the blocks aligned at one end, between the top of one of the blocks and the lowermost tread on the next longer block. In the embodiment of FIG. 1, this dimension s is equal to dimensions r and r′. Although not specifically called out on the drawings, this relationship exists between each block and the next longer block. As a result of the relationships heretofore set forth, in the preferred embodiment the dimension f is twice the dimension r and twice the dimension r′.

Referring now to FIG. 1, it can be seen that blocks 22 through 37 may be positioned within base container 38 with either end engaging base 40 and the opposite end turned upwardly. Likewise, the blocks may be positioned in any order or position to produce the desired visual effect. Specifically with respect to the arrangement of FIG. 1, blocks 22, 23 and 24 are positioned with ends 22*b*, 23*b* and 24*b* upwardly. Blocks 25 and 26 are positioned with ends 25*a* and 26*a* upwardly. As a result, the effect is that of a continuous stairway moving up blocks 22, 23 and 24 turning at blocks 25 and 26 in an ascending left-hand turn. Block 27 has end 27*b* positioned upwardly while block 28 has end 28*a* positioned upwardly. Block 29 also has end 29*a* positioned upwardly. As a result, the arrangement of FIG. 1 generates the continuation of the stairway upwardly along block 27 with an ascending right-hand turn at blocks 28 and 29.

Block 30 has end 30*b* positioned upwardly. Blocks 31 and 32 have ends 31*a* and 32*a*, respectively, positioned upwardly. Blocks 33 and 34 have ends 33*b* and 34*b* positioned upwardly. Block 35 has end 35*a* positioned upwardly and blocks 36 and 37 have ends 36*b* and 37*b*, respectively, positioned upwardly. As a result, the arrangement of FIG. 1 continues the stairway effect along block 30, with an ascending left-hand turn at blocks 31 and 32, continuing upwardly along blocks 33 and 34, with an ascending left-hand turn at block 35, continuing upwardly along blocks 36 and 37.

As can be appreciated, the present invention provides the ability to position either a pair of straight treads or turning treads at any position and at any of the heights provided by blocks 22 through 37. Thus, an almost limitless number of arrangements of either continuous or noncontinuous stairway segments can be generated as a result of the positioning of the blocks within base container 38 in the numerous positions and arrangements possible.

Figure 5:
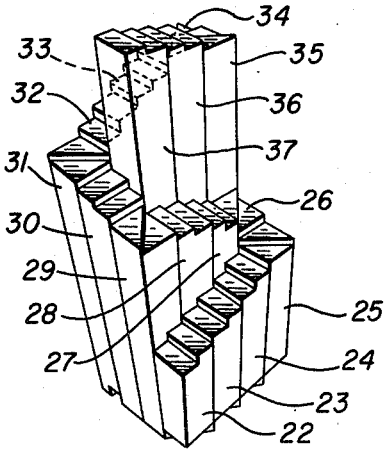
FIG. 5 is a perspective view of the puzzle of the present invention illustrated in FIG. 1 with the blocks rearranged in a second configuration and removed from the base container.

Referring to FIG. 5, the embodiment illustrated in FIG. 1 is shown rearranged such that the blocks are repositioned to produce a different and distinct appearance from that shown in FIG. 1. Although the blocks are shown in a four-by-four arrangement, it will be understood that the blocks may be rearranged in any relationship other than the square arrangement shown, and that an appropriately shaped base container could be provided to hold them in that configuration.

As is shown in FIG. 5, the blocks may be arranged on end without the use of base container 38. While it may be found to be advantageous to use a base container for arranging the blocks therein, it will be understood that the present invention is also directed to the embodiment illustrated in FIG. 5 wherein no base container is used. In this embodiment, the blocks may be positioned without side restraint on a flat surface or may be held together by other means such as a band or interconnecting surfaces formed on the sides of each block. Alternatively, a completed arrangement of blocks may be held together by other mechanical means such as appropriate clamps, screws, bolts or adhesives.

Figure 6:
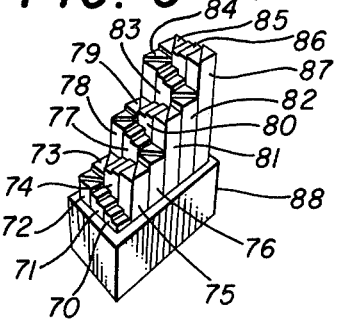
FIG. 6 is a perspective view of an alternative embodiment of the puzzle of the present invention using a different number of blocks than used in the embodiment of FIGS. 1–5.

Referring to FIG. 6, an alternative arrangement of the present invention is shown wherein blocks 70 through 87 are provided for positioning in a rectangular base container 88. As can be seen in FIG. 6, base container 88 is dimensioned to receive the blocks therein with three blocks across the width and six blocks along the length of the base container. As in the embodiment illustrated in FIGS. 1–5, each block is provided with one end rabbeted along the diagonal to provide two turning treads separated by a riser and a second end rabbeted to provide two straight treads separated by a riser.

Although the embodiments illustrated disclose the use of a square and a rectangular base container with the blocks positioned in a square or rectangle arrangement, it will be appreciated that the invention is not limited to such an arrangement. For example, an L-shaped or T-shaped base container could be provided, it being desirable that the configuration of the interior of the base container be one which can be duplicated by the blocks positioned within the container.

Although FIGS. 1–6 illustrate the preferred embodiment as having elongated blocks with square cross sections, it will be appreciated that blocks with rectangular cross sections may also be employed in practice of the present invention. It will also be understood that although the present invention has been described and illustrated such that the dimensions r, r′ and s are equal, this relationship need not be maintained for the practice of the present invention. By maintaining this relationship, however, a uniform stairway arrangement may be generated by arrangement of the blocks of the present invention. However, different effects may be created where, for example, the dimensions r and r′ are equal but are less than or greater than the dimension s. Moreover, different effects may be created where, for example, the dimensions r, r′ and s are not equal one to the other. Further, it will be understood that the present invention also covers the situation where the dimensions r and r′ are different for each of the various blocks.

Further, it is not necessary that the dimensional variance of one block to the next shorter block be equal to practice the present invention. Indeed, it may be beneficial to have blocks of identical length or of lengths that vary one to the other to permit the creation of more unusual designs than those illustrated in the embodiments of FIGS. 1–6.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications and substitutions of parts and elements as fall within the spirit and scope of the invention.

I claim:

1. A puzzle comprising:

a plurality of elongated blocks, each having a rectangular cross section and a first end rabbeted along a diagonal to form two turning treads separated by a riser and a second end rabbeted to form two straight treads separated by a riser, said blocks being arrangeable in a side-by-side relation to define a desired configuration.

2. The puzzle according to claim 1 wherein said blocks have a square cross section.

3. The puzzle according to claim 1 wherein said blocks vary in length one from the other.

4. The puzzle according to claim 1 wherein the dimension of the riser between the two treads on each end of each said block is equal for each block.

5. The puzzle according to claim 1 further comprising a base container for receiving the blocks therein having a bottom and sidewalls extending upwardly therefrom to facilitate confining said blocks with one end of each said block engaged against the bottom of said base container.

6. The puzzle according to claim 1 wherein each block differs in length from the next shorter block by an equal increment.

7. The puzzle according to claim 6 wherein said incremental difference between the lengths of said blocks is equal to twice the dimension of the riser between the treads formed on each end of said block.

8. A puzzle comprising:

a plurality of elongated blocks of rectangular cross section, each having a first end rabbeted along one of the diagonals of the rectangular cross section to form two turning treads separated by a riser thereon and a second end opposite the first end rabbeted to form two straight treads separated by a riser; and a base container having a bottom and sidewalls extending therefrom for receiving said blocks therein with either the first or second end of each block engaging the bottom of said base container thereby exposing either the first or second end of each block to form a desired configuration of said blocks extending from said base container.

9. The puzzle according to claim 8 wherein said base container has a bottom substantially equal in area to the sum of the cross-sectional area of said blocks.

10. The puzzle according to claim 8 wherein the bottom of said base container is rectangular.

11. The puzzle according to claim 8 wherein the bottom of said base container is square.

12. The puzzle according to claim 8 wherein said blocks have a square cross section.

13. The puzzle according to claim 8 wherein each block differs from the next shorter block by an equal increment.

14. The puzzle according to claim 13 wherein the dimension of the riser between the treads formed on each end of each said block is equal one to the other and equal for each said block and wherein said dimensional variation between the lengths of the blocks is equal to twice the dimension of the riser between the treads formed on each end of each said blocks.

* * * * *